US009217116B2

(12) United States Patent
Huang

(10) Patent No.: US 9,217,116 B2
(45) Date of Patent: Dec. 22, 2015

(54) BIOGAS PURIFICATION SYSTEM AND METHODS OF USE THEREOF

(71) Applicant: Southwest Research Institute, San Antonio, TX (US)

(72) Inventor: Francis Y. Huang, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 156 days.

(21) Appl. No.: 14/063,710

(22) Filed: Oct. 25, 2013

(65) Prior Publication Data

US 2015/0119623 A1 Apr. 30, 2015

(51) Int. Cl.
*C10L 3/10* (2006.01)

(52) U.S. Cl.
CPC ..... *C10L 3/102* (2013.01); *C10L 3/101* (2013.01)

(58) Field of Classification Search
None
See application file for complete search history.

(56) References Cited

U.S. PATENT DOCUMENTS 5,792,438 A 8/1998 Scranton, Jr.
7,306,652 B2 12/2007 Higgins

FOREIGN PATENT DOCUMENTS

JP 2012254421 A 12/2012
WO 2008089147 A2 7/2008

OTHER PUBLICATIONS

Abatzoglou, et al., "A Review of Biogas Purification Processes"; Society of Chemical Industry and John Wiley & Sons, Ltd., Biofuels, Bioproducts & Biorefining, vol. 3, pp. 42-71, (2009).
Adib, et al, "Analysis of the Relationship Between H2S Removal Capacity and surface Properties of Unimpregnated Activated Carbons", Environmental Science & Technology, vol. 34, No. 4, (2000), pp. 686-692.
Adib, et al., "Effect of pH and Surface Chemistry on the Mechanism of H2S Removal by Activated Carbons", Journal of Colloid and Interface Science, 216, pp. 360-369, (1999).
Ajhar, et al, "Siloxane Removal from Landfill and Digester Gas—A Technology Overview"; Bioresource Technology, 101, (2010), pp. 2913-2923.
Ajhar, et al, "Siloxane Removal With Gas Permeation Membranes", Desalination 200 (2006), pp. 234-235, presented at Euromembrane 2006, Sep. 24-28 Giardini Naxos, Italy.
Allen, et al, "Analysis of the Trace Volatile Organic Compounds in Landfill Gas Using Automated Thermal Desorption Gas Chromatography-Mass Spectrometry"; Inter. J. Environ. Anal. Chem., vol. 62., pp. 43-52, (1996).
Anerousis et al., "Iron Sponge: Still a Top Option for Sour Gas Sweetening", Technology, Feb. 18, 1985, Oil and Gas Journal., pp. 71-76, (1985).

(Continued)

*Primary Examiner* — Tam M Nguyen
(74) *Attorney, Agent, or Firm* — Grossman, Tucker et al.

(57) ABSTRACT

The present disclosure relates to a biogas purification system and method for removal of sulfur and halogenated compounds and acidic reaction products from biogas. A contaminant removal module is supplied containing a catalytic oxidation catalyst comprising vanadium oxide ($V_2O_5$) on a metal oxide support where the catalyst oxidizes 85% or more of the sulfur and halogenated compounds. This may be followed by a contaminant removal module containing alkali impregnated carbon which removes 85% or more of the acidic reaction products. If siloxane impurities are present in the biogas, one may utilize a contaminant removal module containing alumina oxide.

10 Claims, 5 Drawing Sheets

(56) References Cited

OTHER PUBLICATIONS

Arsova, et al., "The State of Garbage in America", 16th Nationwide Survey of MSW Management in the U.S., BioCycle, 40, Dec. 2008, pp. 22-29.
Bari, "Effect of Carbon Dioxide on the Performance of Biogas/Diesel Duel-Fuel Engine", World Renewal Energy Congress, Renewable Energy, vol. 9, pp. 1007-1010, (1996).
Bashkova, et al., "Selective Catalytic Oxidation of Hydrogen Sulfide on Activated Carbons Impregnated with Sodium Hydroxide" Energy and Fuels, vol. 23, pp. 1674-1682, (2009).
Bertinchamps, "Total Oxidation of Chlorinated VOCs on Supported Oxide Catalysts, Ph.D. Thesis"; Universite Catholique de Louvain, accessed Dec. 9, 2013 <<htpp://hdl.handle.net/2078.1/4582.
Broekhuis, et al, "A Medium-Temperature Process for Removal of Hydrogen Sulfide from Sour Gas Streams with Aqueous Metal Sulfate Solutions", Ind. Eng. Chem. Res. (1992), vol. 31, No. 12, pp. 2635-2642.
Busca, et al, "Evaluation of V2O5—WO3—TiO2 and alternative SCR Catalysts in the Abatement of VOCs", Catalysis Today, vol. 53 (1999), pp. 525-533.
Carabineiro, et al, "Adsorption of SO2 Using Vanadium and Vanadium—Copper Supported on Activated Carbon", Catalysis Today, vol. 78 (2003), pp. 203-210.
Chang, et al, "Destruction of PCDD/FS by SCR from Flue Gases of Municipal Waste Incinerator and Metal Smelting Plant"; Chemosphere 66, (2007), pp. 1114-1122.
Debecker, et al., "Abatement of Model Molecules for Dioxin total Oxidation on V2O5—WO3/TiO2 Catalysts: The Case of Substituted Oxygen-Containing VOC", Journal of Molecular Catalysis A: Chemical 289 (2008) pp. 38-43.
Debecker, et al., "One-Step Non Hydrolytic Sol-Gel Preparation of Efficient V2O5—TiO2 Catalysts for VOC Total Oxidation", Applied Catalysis B: Environmental 94 (2010), pp. 38-45.
Dewil, et al., "Energy Use of Biogas Hampered by the Presence of Siloxanes" Energy Conyers. Managmt, vol. 47, pp. 1711-1722, (2006).
Eklund, et al., "Characterization of Landfill Gas Composition at the Fresh Kills Municipal Solid-Waste Landfill" Environmental Science & Technology., vol. 32, pp. 2233-2237, (1998).
Everaert, et al, "Catalytic Combustion of Volatile Organic Compounds", Journal of Hazardous Materials B109 (2004), pp. 113-139.
Finocchio, et al., "A Study of the Abatement of VOC Over V2O5—WO3—TiO2 and Alternative SCR Catalysts" Catalysis Today, vol. 59 (2000), pp. 261-268.
Finocchio, et al., "Purification of Biogases from Siloxanes by Adsorption: On the Regenerability of Activated Carbon Sorbents" Energy & Fuels, vol. 23, 4156-4159, (2009).
Foster, et al., "Changes in Atmospheric Constitutes and in Radiative Forcing" Climate Change 2007: The Physical Science Basis, Cambridge University Presspp 129-234.
Guillemot, et al, "Volatile Organic Compounds (VOCs) Removal Over Dual Functional Adsorbent/Catalyst System"; Science Direct, Applied Catalysis B: Environmental 75, 2007, pp. 249-255.
Guo, et al., "Adsorption of Sulfur Dioxide onto Activated Carbons Prepared from Oil-palm Shells Impregnated with Potassium Hydroxide", Journal of Chemical Technology and Biotechnology, 75, pp. 971-976, 2000.
Guo, et al., "Adsorption of Sulphur Dioxide onto Activated Carbon Prepared from Oil-palm Shells With and Without Pre-impregnation" Separation and Purification Technology, 30, pp. 265-273, 2003.
Hara, "Biomass Conversion by a Solid Acid Catalyst"; Energy & Environmental Science, 3, pp. 601-607, 2010.
Heneghan, et al., "The Destruction of Volatile Organic Compounds by Heterogeneous Catalytic Oxidation" Catalysis, vol. 17, The Royal Society of Chemistry, 2004, pp. 105-151.
Hobson, et al., "Methane Production from Agricultural and Domestic Wastes" Applied Science Publishers, London, p. 152, 1981.
Jawurek, et al., "Biogas/ Petrol Dual Fuelling of Si Engine for Rural Third World Use"; Applied Science Publishers Ltd., Biomass 13, pp. 87-103, 1987.
Jiang, et al., "Unregulated Emissions from a Diesel Engine Equipped with Vanadium- Based Urea- SCR Catalyst", Science Direct, Journal of Environmental Science, 2010 22(4), pp. 575-581.
Keating, "Cheaper Energy by Going to Waste"; Business Energy/ Articles accessed Nov. 8, 2013 <<htpp://www.distnbutedenergy.com/DE/Articles/Cheaper_Energy_by_Going_to_Waste_28 (3 pgs).
Koebel, et al., "Oxidation of Diesel—Generated Volatile Organic Compounds in the Selective Catalytic Reduction Process"; Industrial Engineering Chemistry Research, 37, pp. 3864-3868, 1998.
Kohn, et al., "Auto-Thermal and Dry Reforming of Landfill Gas Over a Rh/γAL2O3 Monolith Catalyst"; Applied Catalysis B: Environmental 94 (2010) 125-133.
Lee, et al., "Adsorption and Reaction Behavior for the Simultaneous Adsorption of NO-NO2 and SO2 on Activated Carbon Impregnated with KOH"; Carbon 41( 2003) 1881-1888.
Lombardi, et al., "Greenhouse Effect Reduction and Energy Recovery from Waste Landfill"; Science Direct, Energy, 31, 2006, pp. 3208-3219.
Lopez, et al., "Low Temperature Catalytic Adsorption of SO2 on Activated Carbon"; Journal of Physical Chemistry C, 112, 2008, pp. 15335-15340.
Mangun, et al., "Adsorption of Sulfur Dioxide on Ammonia-Treated Activated Carbon Fibers" Carbon 39, 1689-1696, 2001.
Miao, et al., "Thermodynamics on Landfill Gas Reforming"; Chem. Eng. Technol. 2009, 32, No. 10, 1617-1624.
Muradov, et al., "Thermocatalytic Conversion of Landfill Gas and Biogas to Alternative Transportation Fuels" Energy & Fuels, 2008, 22, 2053-2060.
Neumann, et al., "Oxidative Absorption of H2S and O2 by Iron Chelate Solutions"; AlChE Journal (vol. 30, No. 1 pp. 62-69, Jan. 1984.
Nguyen-Thanh, et al., "Adsorption of Hydrogen Sulfide on Montmorillonites Modified with Iron"; Chemosphere 59 (2005) pp. 343-353.
Philip, et al., "Iron(III) Chelate Complexes of Hydrogen Sulfide and Mercaptansin Aqueous Solution"; Inorganic Chemistry, vol. 13, No. 2, 1974, pp. 384-386.
Popat, et al., "Biological Removal of Siloxanes from Landfill and Digester Gases: Opportunities and Challenges" Environmental Science & Technology, vol. 42, No. 22, 2008, pp. 8510-8515.
Rasi, et al., "Trace Compounds of Biogas from Different Biogas Production Plants" Energy 32 (2007), pp. 1375-1380.
Schaller, "Biogas—Energy to Reckon With . . . "; Water and Wastewater International, 23, 00. pp. 14-17, 2008.
Schweigkofler, et al., "Removal of Siloxanes in Biogases"; Journal of Hazardous Materials B83 (2001), pp. 183-196.
Soreanu, et al., "Approaches Concerning Siloxane Removal from Biogas—A Review" ; Canadian Biosystems Engineering, vol. 53, 2011, pp. 8.1-8.18.
Sumathi, et al., "Selection of Best Impregnated Palm Shell Activated Carbon (PSAC) for Simultaneous Removal of SO2 and NOx"; Journal of Hazardous Materials 176 (2010), pp. 1093-1096.
Themelis, et al., "Methane Generation in Landfills", Renewable Energy 32 (2007) pp. 1243-1257.
Truong, et al., "A H2S Reactive Adsorption Process for the Purification of Biogas Prior to its Use as a Bioenergy Vector"; Biomass and Bioenergy 29 (2005) pp. 142-151.
Urban, et al., "Catalytically Upgraded Landfill Gas as a Cost- effective Alternative for Fuel Cells"; Journal of Power Sources 193 (2009) pp. 359-366.
US Environmental Protection Agency, "Energy Projects and Candidate Landfills", Landfill Methane Outreach Program, http://www.epa.gov/lmop/projects-candidates/index.html, LMOP Landfill Database, 2011.
Waste Management, Inc. Waste Management and Linde to Develop the World's Largest Landfill Gas to LNG Facility, Business Wire, 2008, Apr. 30, Business Insights: Essentials, Web Nov. 7, 2013.
Wheless, et al., "Siloxanes in Landfill and Digester Gas Update"; Landfill Gas Conference, Mar. 22-15, 2004 http://www.scsengineers.com/Papers/Pierce_2004Siloxanes_Update_Paper.pdf.

(56) References Cited

OTHER PUBLICATIONS

Wu, et al., "Removal of Hydrogen Sulfide and Sulfur Dioxide by Carbons Impregnated with Triethylenediamine"; Journal of the Air & Waste Management Assoc. Vo. 57, Dec. 2007, pp. 1461-1468.

Xu, et al., "Removal of SO2 from O2-containing Flue Gas by Activated Carbon Fiber (ACF) Impregnated with NH3"; Chemosphere 62 ( 2006) pp. 823-826.

Zhu, et al., "Experimental Study of Regeneration and Optimization of Reaction Conditions for a Catalyst for Simultaneous Removal of NO and SO2 From Waste Gas"; Journal of Beijing University of Chemical Technology, vol. 33, No. 4, 2006, English Abstract Only.

BIOGAS PURIFICATION SYSTEM AND METHODS OF USE THEREOF

FIELD

The present disclosure relates to purification of biogas, and more particularly removing contaminants from biogas. Such purification involves the sequential removal of siloxanes, sulfur and halogenated compounds and acidic gases.

BACKGROUND

In recent years, there has been increasing interest in utilizing biogas as a renewable energy source. The utilization of biogas has two significant benefits: (1) averting greenhouse gas (GHG) emissions, and (2) providing alternative energy resources to mitigate the dependency upon non-renewable fuels, e.g. oil and coal. As such, complete and efficient utilization of readily available biogas is attractive as the demand for energy increases.

Landfill biomass, which is approximately 67% municipal solid waste (MSW), anaerobically decomposes in landfills to provide renewable methane-containing gases (RMG) that are important resources for alternative energy. Other sources of renewable methane-containing gases include digester biogas that is generated by anaerobic digestion or fermentation of animal, agricultural, and other types of biodegradable wastes. However, landfill gases (LFG) may be understood as being more abundant than digester gases.

The constituents of landfill gases are typically methane (20-60%) and carbon dioxide (22-60%). Additionally, landfill gases contain nitrogen (10-15%), oxygen (0-5%), other trace compounds, and are saturated with water vapor. However the composition may vary depending on the type of waste and the age of the landfill. The high methane content makes landfill gas a desirable energy source.

Carbon dioxide may be removed from landfill gas using available technologies, e.g., amine-scrubbing, cryogenic absorption, selective adsorption, membrane separation, etc., and the resulting methane, called biomethane, can be used as a substitute for natural gas (NG). For low BTU applications (≤500 btu/cf), carbon dioxide in LFG is not typically removed. Instead, with improvement in engine designs, the majority of reciprocating engines for power generation in use today operate without removal of carbon dioxide in landfill gas, e.g., Caterpillar G3520 or GE Jenbacher Types 2-6.

However, from a chemical standpoint, a significant challenge of using landfill gas for low BTU operation is in the area of contaminants, which can be detrimental to the engines by causing corrosion, erosion, fouling, etc. As such, frequent maintenance or repairs are needed causing unwanted interruption of electricity generation and increases in operating costs.

Cost effective technologies for removing these contaminants are needed for future use of low BTU applications. The requirements are equally important in high BTU applications (>500 btu/cf) in which, in addition to the removal of $CO_2$, nitrogen and oxygen in the LFG must be removed to meet the pipeline specification, e.g., <4% nitrogen and <0.2% oxygen.

SUMMARY

The present disclose provides relatively more economical and efficient approaches for biogas purification. More particularly, the present disclosure provides systems and methods to purify biogas in the context of protecting the biogas process operating equipment, reducing the downtimes of operation, increasing gas quality and producing pipeline quality renewable fuels. The technologies employed may also be applied to the operations of beneficial chemicals production using biogas as a feed, particularly for processes which are relatively sensitive to the common contaminants found in biogas.

The present disclosure provides modular purification systems suitable for new plant installation or retrofitting existing biomethane production and power generation systems. The systems may comprise up to three contaminants removal modules: (1) a first module to remove siloxanes (if present); (2) a second module to oxidize sulfur- and halogen-containing compounds; and (3) a third module to remove acid gases resulting from the decomposition of sulfur- and halogen-containing contaminants.

More specifically, the present disclosure relates to a biogas purification system and method for removal of sulfur and halogenated compounds and acidic reaction products from biogas, the system comprising a contaminant removal module containing a catalytic oxidation catalyst comprising vanadium oxide ($V_2O_5$) on a metal oxide support where the catalyst oxidizes 85% or more of said sulfur and halogenated compounds. This may be followed by a contaminant removal module containing alkali impregnated carbon wherein the alkali comprises an ionic salt of an alkali metal or alkaline earth metal and is present at a level of 5-15% by weight wherein such contaminant removal module removes 85% or more of the acidic reaction products.

The system and method is also one such that the purified biogas, after oxidation of the sulfur and halogenated compounds and removal of the acidic reaction product is combusted, such as for electricity generation, producing heated exhaust gases wherein such exhaust gases are employed to heat any one of the contaminant removal modules to improve such module's efficiency.

The system and method is also one such that the biogas, in the high BTU applications, after removal of said sulfur and halogenated compounds and the acidic compounds, may be treated for removal of carbon dioxide ($CO_2$), nitrogen or oxygen, wherein the removal results in recovery of a methane offgas, wherein the methane is employed to heat any one of the contaminant removal modules and improve such module's efficiency.

FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
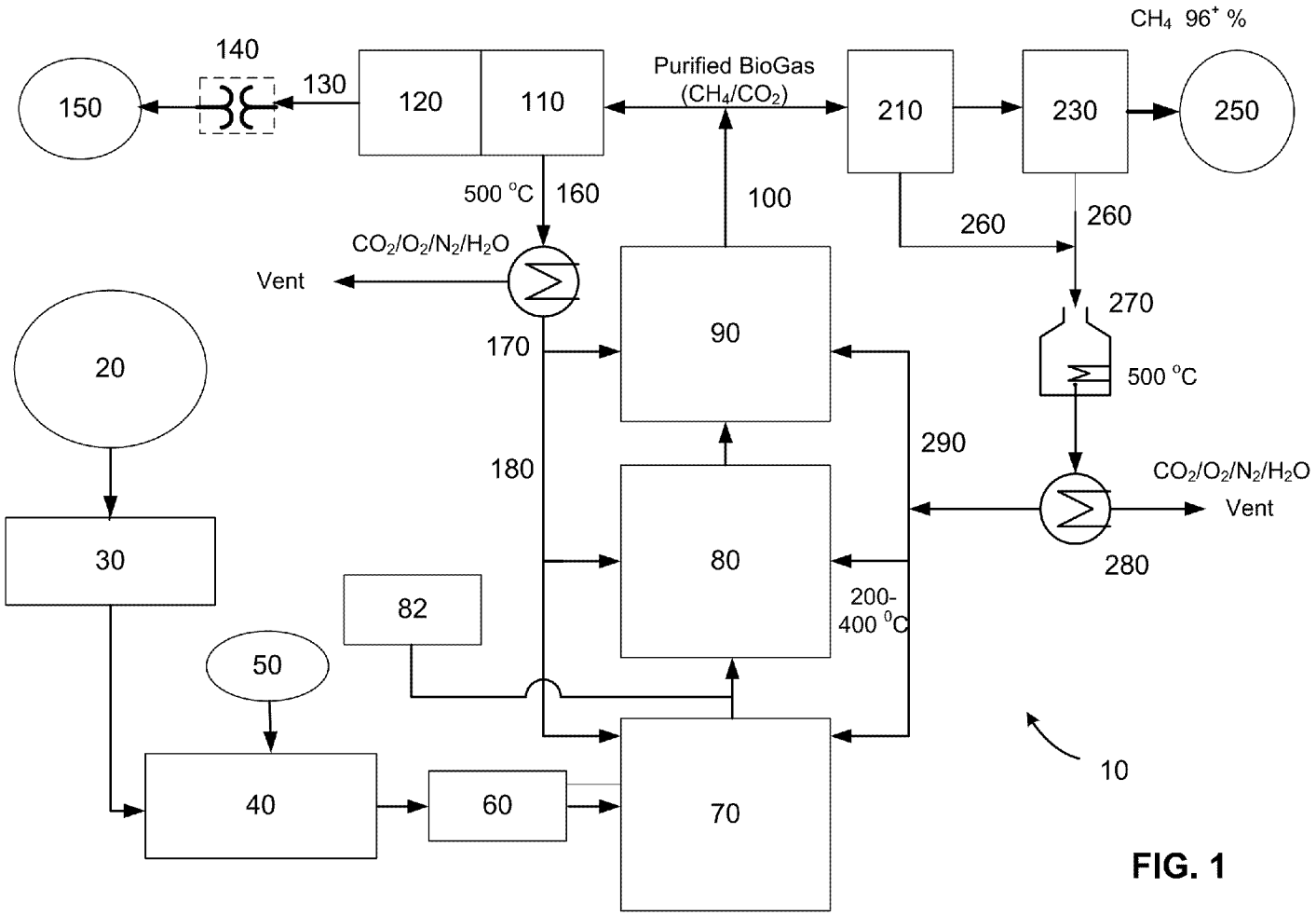
FIG. 1 is a block diagram of a biogas purification system according to the present disclosure.

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

Referring now to FIG. 1, there is shown an exemplary biogas purification system 10 which may be used to remove contaminates from biogas to purify and improve the quality of the biogas according to the present disclosure, with the system 10 being applicable for both high BTU (>500 btu/cf) and low BTU (≤500 btu/cf) biogas applications.

The exemplary biogas purification system 10 may be used to remove a number of different contaminates from biogas. As used herein, biogas may be understood as gas produced by the decomposition of organic matter. Such decomposition of organic matter may occur by anaerobic digestion (decomposition without oxygen). Biogas may be generated and obtained from, for example, landfills (landfill gas or LFG) and anaerobic digesters (biogas generated by anaerobic digestion of animal/livestock, agricultural, sewage treatment plant and other types of biodegradable wastes).

The contaminated biogas, and particularly contaminated biogas from LFG may include contaminants such as hydrogen sulfide ($H_2S$), and a broad spectrum of volatile organic compounds (VOC) including organic-sulfur compounds (e.g. carbonyl sulfide, mercaptans), silicon-containing compounds (e.g. volatile methyl siloxanes, VMS), halogenated compounds, and hydrocarbons (aromatics and aliphatic). Using biogas contaminated with the foregoing contaminates for power generation may result in damage to the downstream power generating units, particularly since, during combustion, the sulfur- and halogen-containing compounds may be transformed into acid gases like sulfuric acid ($H_2SO_4$), hydrochloric acid (HCl) and hydrofluoric acid (HF) which cause corrosion problems.

Furthermore, among the contaminants, volatile methyl siloxanes may have the most adverse physical damage effects, since such compounds decompose to crystalline silica, which may deposit on the engine parts contributing to abrasion and build-up of layers that inhibit essential heat conduction or lubrication, resulting in poorer combustion efficiency. Such physical damage may attribute to shorter lifetimes for the machinery, more frequent maintenance and, subsequently, higher operating costs. Therefore, plant operators face a trade-off decision between installing gas purification equipment and combating the problems with more frequent downtime for maintenance.

Given the unpredictable nature of equipment downtime, plant operators may prefer to eliminate the harmful contaminants in biogas with the biogas purification system 10 of the present disclosure. Catalytic methods for biogas purification used in the present disclosure have been found to provide acceptable removable efficiencies and operational costs, particularly by reducing the relatively complex contaminant compounds into one compound class, e.g. acidic gases, which can be easily removed by using solid sorbents.

As shown in FIG. 1, contaminated biogas may first be obtained and introduced to the biogas purification system 10 from a biogas source 20. The biogas may be obtained from a landfill and/or anaerobic digester, such as a covered anaerobic lagoon, a plug flow digester, complete mix digester, induced blanket reactor, fixed film digester or batch digester. The biogas may be introduced to the biogas purification system 10 through a pipeline from the biogas source.

The contaminated biogas from biogas source 20 may be first exposed to a water condensate remover 30 to initially remove water vapor from the biogas. Typically, the water is removed at this point in the process such that the remaining water content is set to a humidity level of between 20-65%. Thereafter the biogas may be processed through a preliminary particulate and VOC remover 40, which may be flushed with water 50, and thereafter processed through filter 60. The particulates removed include those particles having a size in the range of greater than 3.0 μm. The level of VOC that may be removed at this stage amounts to about 20-40% of the VOC in the biogas.

Upon leaving filter 60, the biogas is now configured to enter a sequential two- or three-module catalytic process in which additional contaminants in the biogas are removed in the order of: (1) silicon-containing compounds (e.g. siloxanes), if present, (2) sulfur- and halogen-containing compounds (e.g. $H_2S$), and (3) acid gases (e.g. $H_2SO_4$, HCl, HF.). The purified biogas may then be fed into a power generation engines (for low BTU applications), or a $CO_2$ separation unit (for high BTU applications), particularly for pipeline quality methane production.

Removal of Siloxane Compounds

Removal of volatile siloxane compounds from biogas herein, if present, occurs in a first contaminant removal module 70. However, it should be noted, and as explained more fully below, there can be situations, such as for farm waste digester biogas treatment, where siloxane removal may not be required.

Siloxanes may be understood herein as compounds having silicon to oxygen bonding, of the general formula —Si—O—Si—, wherein the Si atom may then itself be covalently bonded to a hydrocarbon group, such as a methyl group (—$CH_3$). The volatile siloxanes may therefore include, but are not limited to the following: hexamethyldisiloxane, octamethyltrisiloxane, decamethyltetrasiloxane, and decamethylpentasiloxane, cyclic hexamethylcyclotrisiloxane, octamethylcyclotetrasiloxane, decamethylcyclopentasiloxane, and decamethylcyclohexasiloxane.

Concentrations of total volatile siloxanes in such biogas in the USA may be in the range of 0.5-32 Si mg/$m^3$. In Europe, the siloxane level may be 20-400 Si mg/$m^3$. As indicated above, the adverse effects of siloxanes in power generation are primarily due to the deposited silicon dioxide that leads to abrasion of engine parts. However, such may now be reduced in module 70 to less than or equal to 0.5 Si mg/$m^3$.

Containment module 70 herein is preferably configured as a catalytic process for siloxane removal, which is reference to the use of alumina oxide ($Al_2O_3$) as a catalyst to convert the siloxane compounds to $SiO_2$. At temperatures of 200° C. and higher, such as in the range of 200° C. to 400° C., and preferably in the range of 275° C. to 325° C., the alumina oxide will promote the conversion of the siloxane compounds within the biogas to $SiO_2$, which will typically become embedded in the pores of the $Al_2O_3$, along with formation of $SO_2$ and $CH_4$. However, the methane content of the biogas remains relatively unchanged by this initial purification of the biogas to remove the indicated siloxane compounds and is typically present at a level of 20-60 volume % along with $CO_2$ present at a level of 22-60 volume %.

The $Al_2O_3$ that is employed herein in module 70 preferably has the following characteristics:

Chemical Composition: $Al_2O_3$ (>90 wt. %); $SiO_2$ (<0.02 wt. %); $Fe_2O_3$ (<0.02 wt. %); $Na_2O$ (<0.30 wt %).

Particle Diameter: 1.5 mm to 6.5 mm

Surface Area: ≥300 $m^2$/g

Total Pore Volume: ≥0.5 mL/g

Bulk Density: 690-755 kg/$m^3$

In certain embodiments, the first contaminant removal module 70 may include one or more aluminum oxide beds that may be a fixed bed. The aluminum oxide may be in particle form. The module 70, as well as modules 80 and 90, and any beds therein may therefore be configured based on the concentration of contaminants in the input biogas and in the final products. Module size and bed size may therefore be sized according to the space velocity (i.e. the ratio of flow rate to the volume of catalyst). By way of example, the beds may therefore have a diameter of 4.0" to 36" and length of 18" to 120". The first contaminant removal module 70 may also include a first circulation device on the input side of the module 70 to push the biogas through the metal oxide beds (e.g. blower, fan), and/or a second circulation device to pull the biogas through the metal oxide beds (e.g. blower, fan, vacuum).

As noted above, in the course of converting the siloxane in the biogas to $SiO_2$ in module 70, the $SiO_2$ will typically deposit on the metal oxide surface. Under these circumstances, it can be appreciated that it will be preferable herein to periodically replace the metal oxide catalyst to promote the more efficient conversion of the siloxanes in the biogas to $SiO_2$. However, given the relatively low cost of metal oxides, the periodic replacement of metal oxide catalyst in the course of purifying biogas herein is now entirely reasonable.

Removal of Sulfur & Halogenated Compounds

Upon leaving the first contaminant removal module 70, if present, the biogas may enter a second contaminant removal module 80. In the second module, sulfur-containing compounds and halogen-containing compounds in the biogas are both removed through another catalytic system. However, in the broad context of the present disclosure, and as discussed more fully below, removal module 80 may be the first module in a biogas treatment facility.

The most common sulfur-containing contaminants are hydrogen sulfide ($H_2S$) and other malodorous compounds, i.e. mercaptans, coming from the anaerobic fermentation of S-bearing organics. Mercaptans are reference herein to organosulfur compounds containing a carbon-bonded sulfhydryl (—C—SH or R—SH) group where R is an alkane, alkene or other carbon-containing group of atoms. Depending on the composition of the organic materials fermented, the $H_2S$ content of biogas from landfill may, in the USA, fall in the range of 1-17,000 mg/m$^3$ and the $H_2S$ content of wastewater treatment plants may fall in the range of 280-1100 mg/m$^3$. The $H_2S$ content from European landfills may fall in the range of 28-860 mg/m$^3$ and the $H_2S$ content from European wastewater treatment plants may fall in the range of 710-4300 mg/m$^3$. This toxic contaminant is highly undesirable in biogas due to its conversion to highly corrosive, unhealthy and environmentally hazardous sulfur dioxide ($SO_2$) and sulfuric acid ($H_2SO_4$) after combustion.

The halogenated organics that are present in biogas include tricholoroethylene (TCE) and chlorofluorocarbon compounds (CFC). Such may therefore include, but not be limited to, dichlorodifluoromethane and chlortrifluoromethane. Accordingly, reference to halogenated organics include carbon-halogen compounds containing a carbon-bonded halogen group (e.g. —C—Cl) which produce corrosive combustion byproducts such as HCl or HF. In the USA, levels of halogens (as Cl) in landfill is reported to fall in the range of 60-491 mg/m$^3$ and levels from wastewater treatment plants fall in the range of <0.1 mg/m$^3$. European landfills report levels of halogen (as Cl) in the range of 20-200 mg/m$^3$ and levels from wastewater treatment plants are in the range of 0.1-5 mg/m$^3$. It is therefore desirable to remove such compounds for the protection of engine components and plant equipment that make use of biogas.

Therefore, it is desirable to identify a removal system that can remove sulfur- and halogen-containing contaminants in landfill biogas prior to its use as biomethane. It has been found herein that catalytic oxidation provides a method for removal of these contaminants and that it can be readily integrated with the catalytic removal system for siloxane noted herein.

The catalytic oxidation removal system herein is preferably selected from a vanadium oxide catalyst (e.g. $V_2O_5$ which is known as vanadium pentoxide). More preferably, a supported vanadium oxide catalyst is employed, which is reference to the use of vanadium oxide deposited on a relatively high surface area metal oxide support (e.g., $TiO_2$, $MnO_2$, CuO, $Fe_2O_3$ and $WO_3$). The metal oxide support acts as a promoter to enhance the activity of the catalyst. Accordingly, with such a system, 85-100% of the indicated sulfur containing compounds and halogen-containing compounds can now be oxidized.

Most preferably, a $V_2O_5/TiO_2$ catalyst is employed in module 80 at temperatures in the range of 200° C. to 400° C., more preferably 250° C. to 400° C. The $V_2O_5$ content is preferably 10-25 wt % of the $V_2O_5/TiO_2$ composition and is present at a particle size diameter of 1-5 mm with a surface area of 40-200 m$^2$/g. The $V_2O_5/TiO_2$ can also be present in one or more beds that may be of a fixed bed configuration.

In addition, as illustrated in FIG. 1, oxygen is supplied by from pump 82. Depending on the level of the contaminants, it is contemplated that additional oxygen needed is relatively small. For example, the level of oxygen that may be supplied by pump 82 may be in the range of 0.5 to 1.0% of the gas volume. As illustrated, removal module 80 is installed downstream of first removal module 70 to minimize the impact of silicon-containing compounds. In addition, the $V_2O_5$ catalyst employed herein is capable of self-regeneration (i.e. the catalyst is not consumed during its role in removal of the indicated sulfur and halogenated compounds).

Removal of Acidic Reaction Products

The products of the catalytic treatment of sulfur- and halogen-containing compounds noted above lead to compounds that may, particularly in the presence of residual moisture, lead to the formation of inorganic acids (e.g., HCl, HF). Accordingly in module 3 identified as 90 in FIG. 1, such acidic reaction products are now preferably removed. Such module may also be heated to temperatures of 200° C. to 400° C.

More specifically, the catalytic treatment of sulfur- and halogen containing compounds noted above lead to sulfur dioxide ($SO_2$), hydrogen chloride (HCl), hydrogen fluoride (HF), and relatively small amounts of partially oxidized species such as carbon dichloride oxide ($COCl_2$), carbon difluoride oxide ($COF_2$), chlorine ($Cl_2$), and nitrogen oxides ($NO_x$). In a third contaminant removal module 90 acidic gas removal can now be sequentially accomplished by adsorption/absorption on appropriate media.

Specifically, alkaline impregnated carbon has been found to effective for simultaneous removal of one or more acidic gases. The impregnation may be accomplished with alkali, which is reference to an ionic salt of an alkali metal or alkaline earth metal. For example, activated carbon impregnated with metal oxides, or impregnation with sodium and potassium hydroxide. The level of impregnation with the indicated alkali is in the range of 5-15 wt. %, preferably 9-11 wt. %. Among these materials, preferably, sodium hydroxide (NaOH) and potassium hydroxide (KOH) impregnated activated carbons, which may include carbon fibers, are a reliable and economic means for simultaneous removing HCl, HF, $SO_2$ and NOx.

Moreover, the level of acidic gas removal in module 90 is greater than or equal to 85%, and preferably falls in the range of 85-98%.

Regeneration of the activated carbon of the third contaminant removal module 90 may be performed. This can be achieved by flushing module 90 with fresh base solution, typically 30-40 wt. % in water, until the solution remains relatively alkaline (pH≥8.0). Module 90 is then dried by heating and air purging.

Upon exit from the third contaminant removal module 90, the biogas is such that it will be suitable for industrial application and will meet or exceed the requirements noted below for electricity production and/or engine requirements, for levels of silicon, sulfur and halogen content.

Biogas Quality Criteria in Electricity Production

| | Reciprocating Engines | Turbine | Microturbine | Fuel Cell (SOFC) | Sterling Engine |
|---|---|---|---|---|---|
| Input Pressure, bar | 0.2-1.4 | 14-24 | 3.5-5.0 | — | 0.14 |
| Total silicon, mg/m$^3$ $CH_4$ | 10-50 | 0.1 | <0.01 | <0.01 | 0.48 (as D4) |
| Sulfur, mg/m$^3$ $CH_4$ | 720-2300 | <13200 | 32-92000 | <1.3 | 370 |
| Halogens (as Cl), mg/m$^3$ $CH_4$ | 86-713 | 2200 | 290 | <7.2 | 340 |

Specific Gas Criteria from Engine Manufacturers

| | Manufacturer A | | Manufacturer B |
|---|---|---|---|
| Total silicon, mg/m$^3$ $CH_4$ | <10 (without catalyzer) | n.d (with catalyzer) | <21 |
| Sulfur, mg/m$^3$ $CH_4$ | <2000 (without catalyzer) | <1150 (with catalyzer) | <2140 |
| Halogens (as Cl), mg/m3 CH4 | <100 (without catalyzer) | n.d (with catalyzer) | <713 |
| Ammonia, mg/m$^3$ $CH_4$ | <55 | | <105 |
| Particles, mg/m$^3$ $CH_4$ | <50 | size < 3 um | <30 |

As can be seen from the above, for electricity production by Fuel Cell, the levels of silicon in the biogas (methane) is preferably less than 0.01 mg/m$^3$, the level of sulfur is less than 1.3 mg/m$^3$ and the level of halogens (as Cl) is less than 7.2 mg/m$^3$. Engine requirements indicate silicon levels of less than 10 mg/m$^3$ (catalytic), sulfur levels of less than 2000 mg/m$^3$, and halogen levels of less than 100 mg/m$^3$. As noted above, depending upon the size of the module selected, the present sequential removal of siloxanes (if present) in the biogas may be at an efficiency of 85-98%, along with removal of 85-100% of the sulfur and halogenated compounds, thereby meeting the above criteria. Accordingly, the biogas produced herein can meet the requirements noted above and now be used more safely and efficiently for both electricity production and engine operation.

As further shown in FIG. 1, the catalytic conversion modules for siloxanes and sulfur/halogen containing compounds, i.e. first contaminant removal module 70 and second contaminant removal module 80, respectively, preferably operate at about 300° C., thus requiring a heat source for operation. Additionally, a heat source is also required for the regeneration of the activated media of the third contaminant removal module 90.

As set forth above, for low BTU applications (≤500 btu/cf), the $CO_2$ in the biogas is not removed. As shown in FIG. 1, the carbon-dioxide containing purified biogas 100 may be used to power a gas engine 110, which may be understood as an internal combustion engine which runs on biogas as a fuel. The crankshaft of the gas engine 110 may be directly coupled to an electric generator 120 to produce electrical power 130, which may then be passed through a voltage step-up transformer 140 and provided to a power grid 150.

For low BTU biogas applications, heated combustion exhaust gas 160 from the gas engine 110 may be used to provided a heat source to heat a circulating fluid 180 of a heat exchanger 170 which heats first contaminant removal module 70 and/or second contaminant removal module 80 and/or third contaminant removal module 90. Thus, the heat exchange 170 may utilize the waste heat from the power generator without incurring any additional energy cost.

A typical landfill biogas engine exhaust gas, containing about 12% $CO_2$ and 88% $N_2$, can reach a temperature of up to 910° F. (488° C.) at a gas flow rate of about 12,000 CFM. Using a gas-to-fluid heat exchanger 170, a substantial amount of the heat will be recovered to heat oil, such as Dowtherm A, from ambient temperature to 572° F. (300° C.) at a flow rate of approximately 5 gals/min (GPM). In a continuous flow system, the amount of heat is sufficient to heat the modules 70, 80 and/or 90. Since the gas-to-liquid heat exchanger requires only 3,000 CFM, about one fourth of the total exhaust gas flow, the remaining heat could be harvested for other uses at site. This waste heat harvesting system is designed to integrate with all the modules in the purification system.

For the high BTU applications (>500 btu/cf) $CO_2$ is removed from the biogas 100 using a $CO_2$ removal apparatus 210. $CO_2$ removal apparatus 210 may comprise a $CO_2$ scrubber. Thereafter, $N_2$ and $O_2$ removal apparatus 230 may be used to further purify the biogas, after which time the purified biogas, now at least 96% methane or higher, may be provided to a pipeline 250. An electric oil heater or a flare 270 is employed to use the offgas (i.e. methane or $CH_4$) 260 from the $CO_2$, nitrogen, and oxygen removal processes. A heating apparatus 270, such as an electric oil heater or a flare, may be used to heat the circulating fluid 290 of heat exchanger 280 which heats first contaminant removal module 70, and/or second contaminant removal module 80 and/or third contaminant removal module 90. Alternatively, untreated biogas could be used.

Thus, the modular biogas purification system herein is flexible in utilizing the combustion of the biogas purified herein to generate heat to augment the performance of any one of modules 70, 80 or 90 to improve their respective contaminant removal performance. In addition, upon removal of $CO_2$, $N_2$ and/or $O_2$ from the purified biogas herein, and off-gas sing of methane during such purification, such methane may now be utilized to also generate heat to again heat and augment the performance of any one of modules 70, 80 or 90. As noted above, such heating may occur in the range of 200° C. to 400° C.

The disclosure provides integrated and comprehensive biogas purification processes, which removes contaminants in a continuous sequential through system. More particularly, the present disclosure provides an integrated catalytic biogas contaminants removal system that consists of three components, illustrated as modules 70, 80 and 90 in FIG. 1. Module 70 is optional depending upon the biogas at issue. The three components may particularly provide (1) removal of siloxanes if present; (2) removal of sulfur- and halogen-containing compounds by catalytic oxidation/hydrolysis using $V_2O_5$/$TiO_2$-based catalysts, and (3) removal of acidic gases resulting from the decomposition of sulfur- and halogen-containing contaminants using regenerable alkaline impregnated activated carbons. In addition, one may selectively increase the capacity of any one of the indicated modules, to customize the removal requirements of a given biogas feedstock.

Since the required heat for the catalytic modules may be harvested from the engine exhaust gas or from a heater using untreated biogas as fuel, the energy cost for the operation of the LFG purification system is now relatively minimal. The entire biogas purification system herein makes use of a continuous flow with thermal swing regeneration for uninterrupted operation. The consumable material of the system herein amounts to the spent alumina sorbent.

Figure 2:
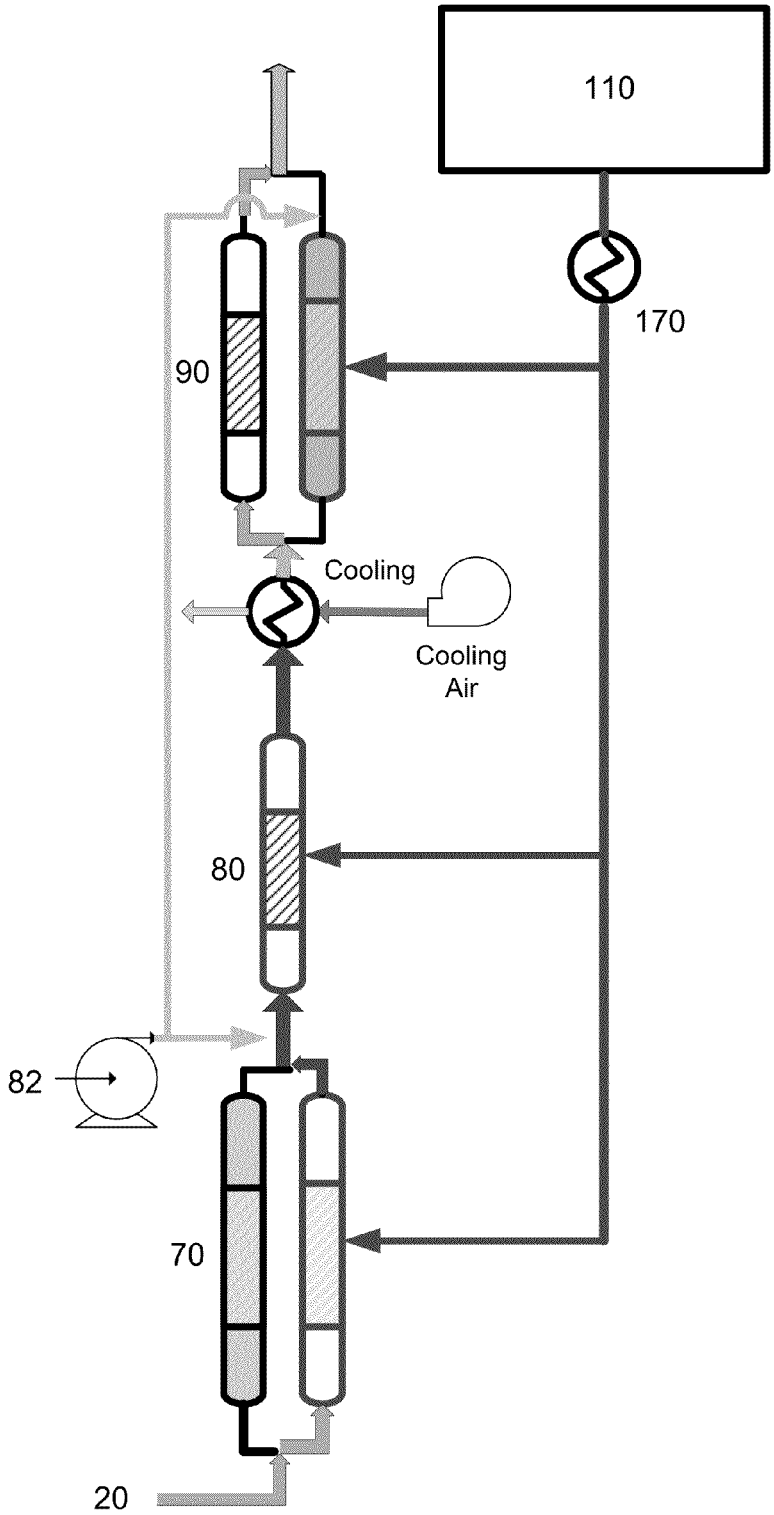
FIG. 2 illustrates the biogas purification system herein for a landfill application.
Figure 3:
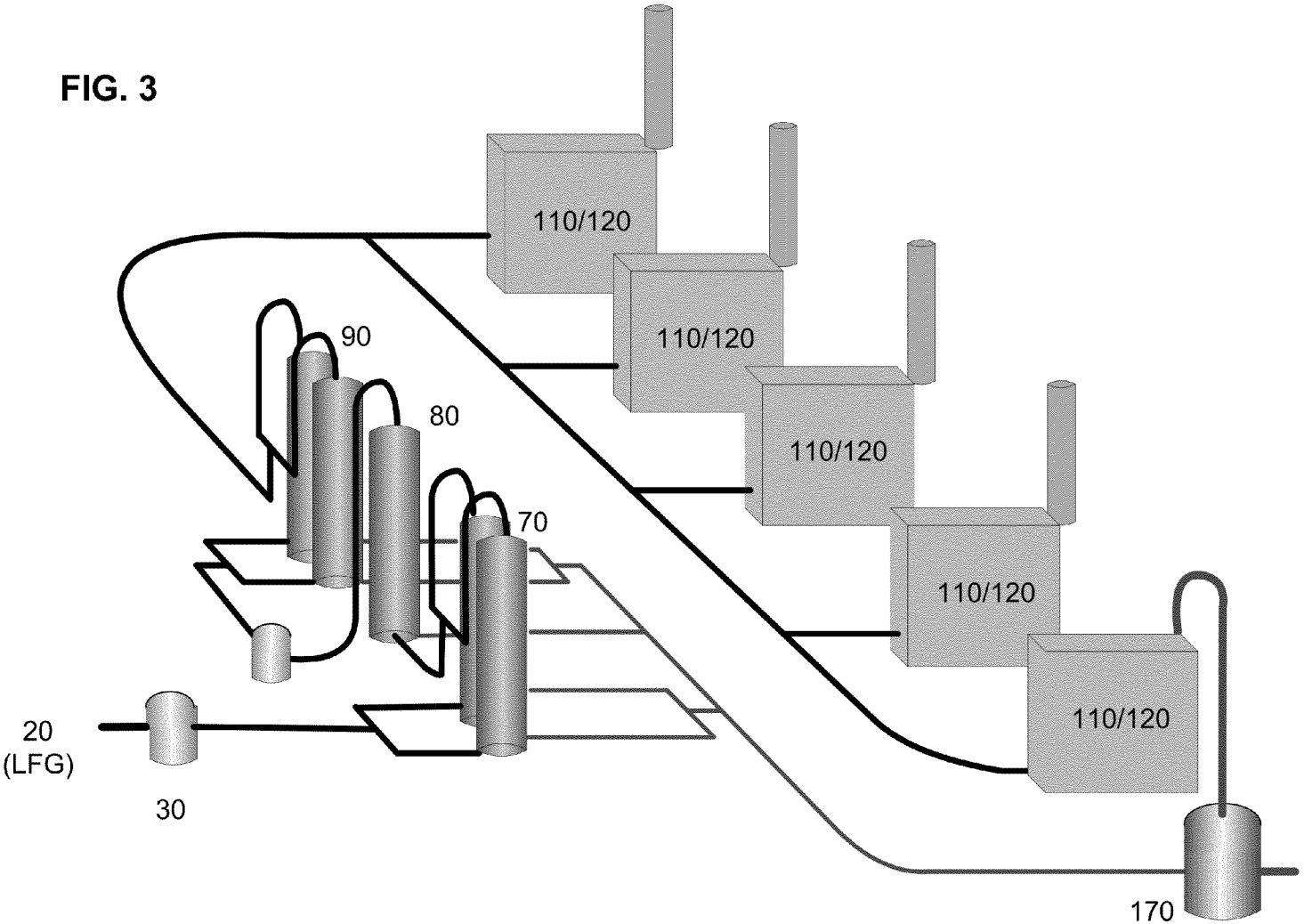
FIG. 3 illustrates a site installation of the system herein for a landfill biogas-to-energy application.
Figure 4:
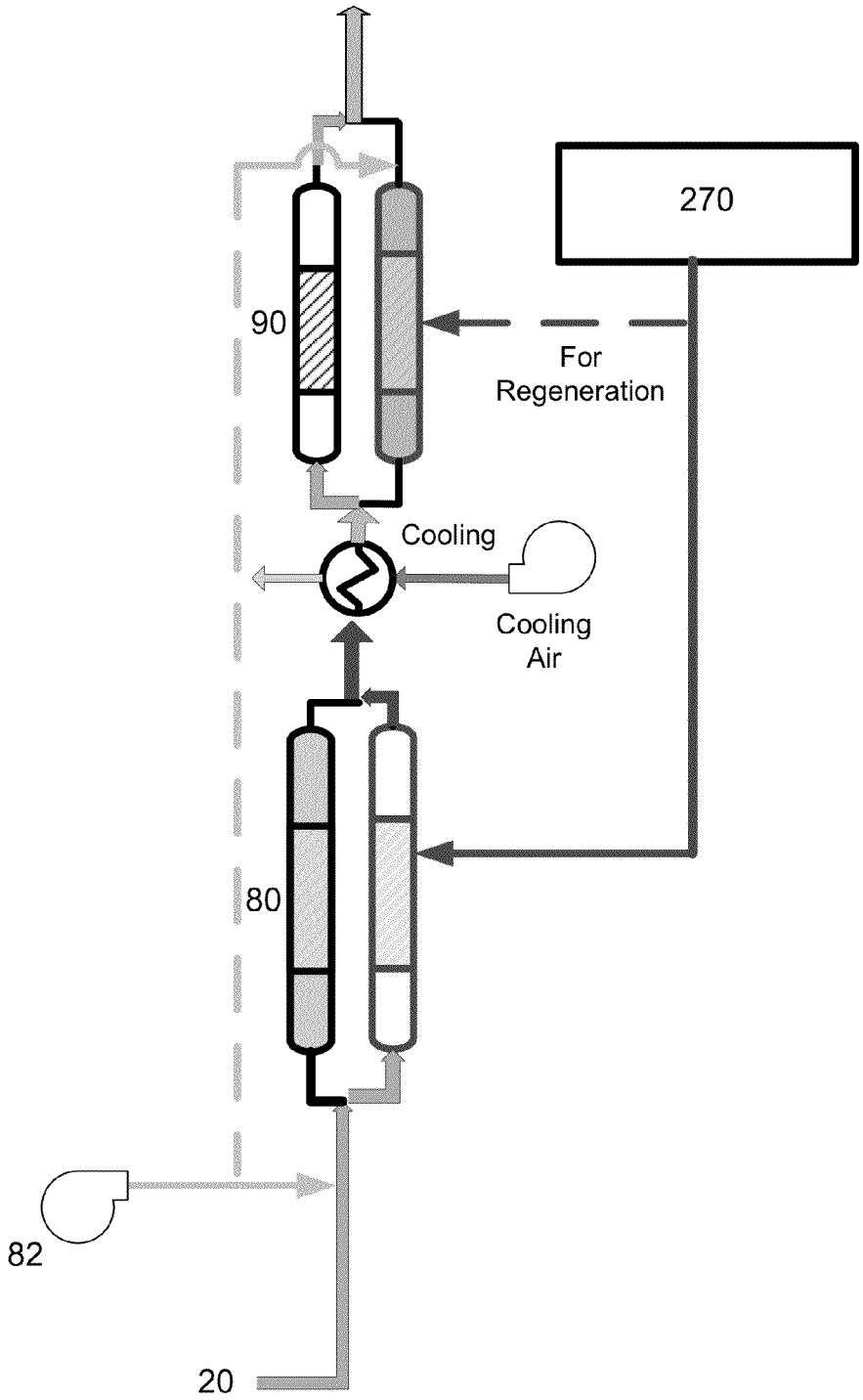
FIG. 4 illustrates the flexibility of the system herein as applied to only halogenated and sulfur compound removal and acidic gas removal from farm waste treatment biogas.
Figure 5:
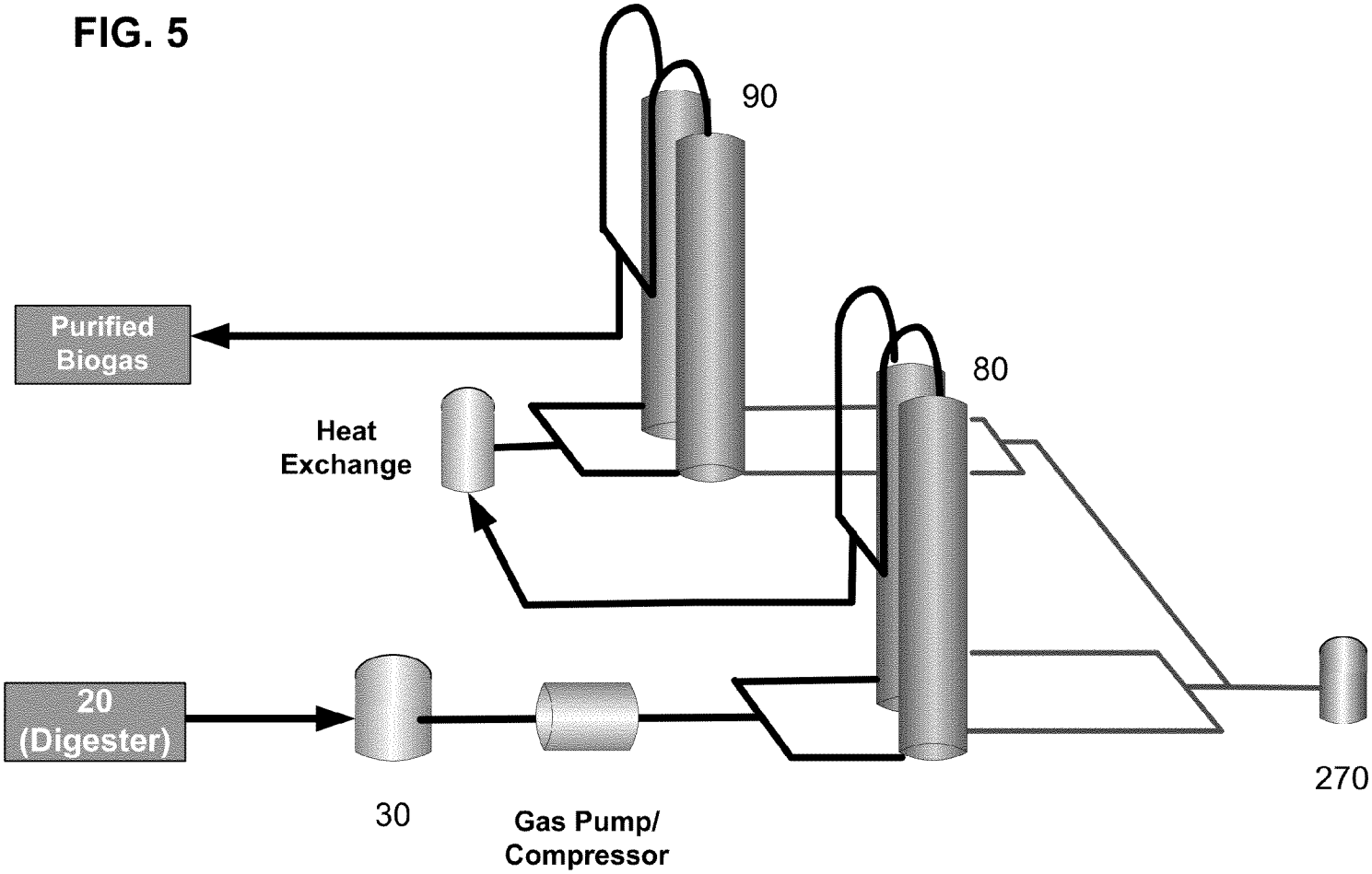
FIG. 5 illustrates a site installation configuration for farm waste biogas treatment.

FIG. 2 depicts the purification system herein with the modules 70, 80 and 90 discussed above and heat flow identified for a landfill biogas purification application. A site install of the system for a landfill biogas-to-energy project is illustrated in FIG. 3. The flexibility of the modular approach of this disclosure is shown in FIG. 4, with the elimination of the siloxane removal module 70 and utilizing only the halogenated and sulfur compound removal module 80 and acidic gas removal module 90. As can be seen, one of the modules 80 or 90 may optionally be set off-line while biogas removal is allowed to continue. A further example of a site installation for the farm waste digester biogas treatment system is also illustrated in FIG. 5.

While a preferred embodiment of the present invention(s) has been described, it should be understood that various changes, adaptations and modifications can be made therein without departing from the spirit of the invention(s) and the scope of the appended claims. The scope of the invention(s) should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

What is claimed is:

1. A method for removal of sulfur and halogenated compounds and acidic reaction products from biogas comprising:

supplying a contaminant removal module containing a catalytic oxidation catalyst comprising vanadium oxide ($V_2O_5$) on a metal oxide support for oxidation of said sulfur and halogenated compounds;

supplying a contaminant removal module containing alkali impregnated carbon for removal of said acidic reaction products wherein the alkali comprises an ionic salt of an alkali metal or alkaline earth metal and is present at a level of 5-15% by weight;

introducing biogas and oxidizing 85% or more of said sulfur and halogenated compounds and removing 85% or more of said acidic reaction products.

2. The method of claim 1 wherein said biogas contains siloxane compounds and supplying a contaminant removal module containing alumina oxide ($Al_2O_3$) and removing a portion of said siloxane compounds prior to removal of said sulfur and halogenated compounds.

3. The method of claim 1 wherein said biogas, after oxidation of said sulfur and halogenated compounds and removal of said acidic reaction products is combusted producing heated exhaust gases and said exhaust gases are employed to heat any one of said contaminant removal modules.

4. The method of claim 1 wherein said biogas, after oxidation of said sulfur and halogenated compounds and removal of said acidic compounds, is treated for removal of carbon dioxide ($CO_2$), nitrogen or oxygen, said removal resulting in recovery of a methane offgas wherein said methane is employed to heat any one of said contaminant removal modules.

5. The method of claim 2 wherein said siloxane removal is at 85-98%.

6. The method of claim 1 wherein said alkali comprises sodium hydroxide or potassium hydroxide.

7. The method of claim 1 wherein said sulfur compounds comprise hydrogen sulfide ($H_2S$) or organosulfur compounds containing a carbon-bonded sulfhydryl (—C—SH or R—SH) group where R is an alkane, alkene or other carbon-containing group of atoms.

8. The method of claim 1 wherein said halogenated compounds comprise trichloroethylene or chlorofluorocarbon compounds.

9. The method of claim 1 wherein said acidic reaction products comprise sulfur dioxide ($SO_2$), hydrogen chloride (HCl), hydrogen fluoride, carbon dichloride oxide ($COCl_2$), carbon difluoride oxide ($COF_2$), chlorine or nitrous oxides (NOx).

10. The method of claim 2 wherein said siloxane compounds comprise hexamethyldisiloxane, octamethyltrisiloxane, decamethyltetrasiloxane, and decamethylpentasiloxane, cyclic hex amethylcyclotrisiloxane, octamethylcyclotetrasiloxane, decamethylcyclopentasiloxane, or decamethylcyclohexasiloxane.

* * * * *